US005887527A

United States Patent [19]

Theurer et al.

[11] Patent Number: 5,887,527

[45] Date of Patent: Mar. 30, 1999

[54] TRACK LINING MACHINE

[75] Inventors: Josef Theurer, Vienna; Friedrich Peitl, Linz, both of Austria

[73] Assignee: Franz Plasser Bahnbaumaschinen-Industriegesellschaft m.b.H., Vienna, Austria

[21] Appl. No.: 284,388

[22] Filed: Aug. 2, 1994

[30] Foreign Application Priority Data

Feb. 4, 1994 [AT] Austria ..... A213/94

[51] Int. Cl.[6] ..... E01B 27/00

[52] U.S. Cl. ..... 104/7.2; 104/2

[58] Field of Search ..... 104/7.2, 7.1, 2, 104/12

[56] References Cited

U.S. PATENT DOCUMENTS

| | | | |
|---|---|---|---|
| 4,046,079 | 9/1977 | Theurer . | |
| 4,248,154 | 2/1981 | Theurer | 104/7.2 |
| 4,399,753 | 8/1983 | Theurer et al. | 104/7.2 |
| 4,770,103 | 9/1988 | Allmer | 104/7.1 |
| 5,113,767 | 5/1992 | Theurer . | |

FOREIGN PATENT DOCUMENTS

| | | | |
|---|---|---|---|
| 1709525 | 10/1976 | Germany | 104/7.1 |
| 2737976 | 6/1978 | Germany | 104/7.1 |
| 2240571 | 8/1991 | United Kingdom | 104/7.2 |

*Primary Examiner*—Mark T. Le
*Attorney, Agent, or Firm*—Collard & Roe, P. C.

[57] ABSTRACT

A track lining machine comprises a machine frame supported on the track by undercarriages, a track stabilization assembly vertically adjustably mounted on the machine frame and engaging the track, the track stabilization assembly comprising a vibrator for generating oscillations of the track engaged by the assembly, a reference system comprising a lining reference base, a lining drive linking the track stabilization assembly to the machine frame for displacing the track engaged by the track stabilization assembly in a direction extending transversely to the track into a position controlled by the lining reference base, and a spacing member interposed between the lining drive and the track stabilization assembly.

5 Claims, 2 Drawing Sheets

TRACK LINING MACHINE

BACKGROUND OF THE INVENTION

1. Field of the Invention

The present invention relates to a machine for lining a track, which comprises a machine frame supported on the track by undercarriages, a track stabilization assembly vertically adjustably mounted on the machine frame and engaging the track, the track stabilization assembly comprising vibrating means for generating oscillations of the track engaged by the assembly, a reference system comprising a lining reference base, and lining drive means linking the track stabilization assembly to the machine frame for displacing the track engaged by the track stabilization assembly in a direction extending transversely to the track into a position controlled by the lining reference base.

2. Description of the Prior Art

U.S. Pat. No. 4,046,079 discloses a machine of this general type. It comprises a machine frame extending in a longitudinal direction and supported on the track by undercarriages and a track stabilization assembly mounted on the machine frame, which incorporates vibrating means for imparting to the track oscillations extending horizontally and perpendicularly to the track, i.e. to the longitudinal direction. The track stabilization assembly comprises adjustable roller clamps and flanged wheels wherebetween the track rails are firmly held while the track is oscillated. Hydraulic lining drives controlled by a lining reference system directly link the track stabilization assembly to the machine frame. These drives are accordingly subjected to the high vibration forces generated by the track stabilization assembly.

A continuously advancing track working machine for compacting ballast and lining the track is disclosed in U.S. Pat. No. 5,113,767. Two such track stabilization assemblies are mounted on the machine frame between the undercarriages supporting respective ends of the machine frame on the track, and a measuring device is arranged on the machine frame between the assemblies for measuring the transverse track displacement.

SUMMARY OF THE INVENTION

It is a primary object of this invention to provide a track lining machine of the first-indicated type, which enables the lining forces to be transmitted to the track stabilization assembly while holding the vibratory forces on the lining drive means to a minimum.

The above and other objects are accomplished with a track lining machine which comprises a machine frame supported on the track by undercarriages, a track stabilization assembly vertically adjustably mounted on the machine frame and engaging the track, the track stabilization assembly comprising vibrating means for generating oscillations of the track engaged by the assembly, and a reference system comprising a lining reference base. Lining drive means links the track stabilization assembly to the machine frame for displacing the track engaged by the track stabilization assembly in a direction extending transversely to the track into a position controlled by the lining reference base and, in accordance with the invention, a spacing member means is interposed between the lining drive means and the track stabilization assembly.

Such an indirect linking of the track stabilization assembly to the machine frame enables the lining drive means to be operated for an effective transmittal of a lining force to the track by the track stabilization assembly without unduly subjecting the lining drive means to vibratory forces. Because the track stabilization assembly is only indirectly linked to the machine frame, the lining drive means will be subjected to the vibratory forces only during the relatively short period of the lining operation.

In one preferred embodiment, the lining drive means comprises at least one lining drive extending in a substantially vertical direction and comprising a piston rod, and the spacing member means comprises a rope connecting the piston rod to the track stabilization assembly. The machine further comprises a guide roller mounted on the machine frame for rotation about a substantially horizontal axis extending substantially parallel to the track, the rope being trained about the guide roller and the guide roller being arranged to deflect the rope about 90°. The track lining machine further comprises a bolt axle mounting the guide roller on the machine frame, and a cylindrical elastic damping element is interposed between the bolt axle and the guide roller. A section of the rope extends horizontally between the guide roller and the track stabilization assembly substantially perpendicularly to the track. This embodiment provides a simple structure and, at the same time, provides a very effective transmission of the lining impacts generated by the lining drive means while protecting the lining drive means from the high vibratory forces. The elastic damping prevents an undesirable transmission of the vibratory forces from the track stabilization assembly to the machine frame.

According to a preferred feature, the lining drive means comprises a respective lining drive mounted at each side of the machine frame, each lining drive extending longitudinally in a substantially vertical direction, and further comprising a respective guide roller mounted on the machine frame for rotation about a substantially horizontal axis extending substantially parallel to the track, the rope being trained about the guide roller and the guide roller being arranged to deflect the rope about 90°. This makes it possible to line the track in either transverse direction.

In accordance with another preferred embodiment, the lining drive means comprises a lining drive, and the spacing member means is a lever extending longitudinally in a substantially vertical direction, the lever having an upper end linked to the lining drive, a lower end linked to the track stabilization assembly, and a fulcrum between the upper and lower ends, the fulcrum linking the lever pivotally to the machine frame. The track stabilization assembly may carry a pair of entrainment bolts spaced from each other transversely to the track, and the lower lever end is engaged between the entrainment bolts. An elastic element is interposed between each one of the entrainment bolts and the lower lever end.

BRIEF DESCRIPTION OF THE DRAWING

The above and other objects, advantages and features of the present invention will become more apparent from the following detailed description of certain now preferred embodiments thereof, taken in conjunction with the accompanying, somewhat schematic drawing wherein.

DETAILED DESCRIPTION OF PREFERRED EMBODIMENTS

Figure 1:
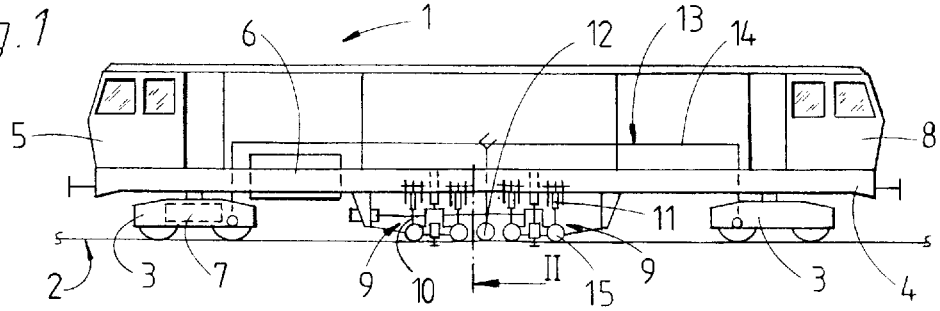
FIG. 1 is a side elevational view of a track lining machine with two track stabilization assemblies, of the type fully disclosed in U.S. Pat. No. 5,113,767.

Referring now to the drawing and first to FIGS. 1 to 4, there is shown machine 1 for lining a track. The illustrated machine is generally known as a dynamic track stabilizer and serves to compact the ballast to settle the ballast bed while lining the track. It comprises machine frame 4 supported on track 2 by undercarriages 3, 3. This self-propelled machine has front and rear operator's cabs 5, 8 and is advanced along the track by drive 7. It carries power plant 6 for providing energy to the operating drives of the machine.

Two track stabilization assemblies 9, 9 are vertically adjustably mounted on machine frame 4 and engage track 2, each track stabilization assembly comprising two vibrators 20, 20 for generating oscillations of the track engaged by the assembly. Reference system 12 comprising lining reference base 13 constituted by tensioned wire chord 14 serves to control lining drives 11, 11 linking each track stabilization assembly 9 to machine frame 4 for displacing track 2 engaged by the track stabilization assembly in a direction extending transversely to the track into a position controlled by the lining reference base. Spacing member 10 is interposed between each lining drive and each track stabilization assembly.

Figure 2:
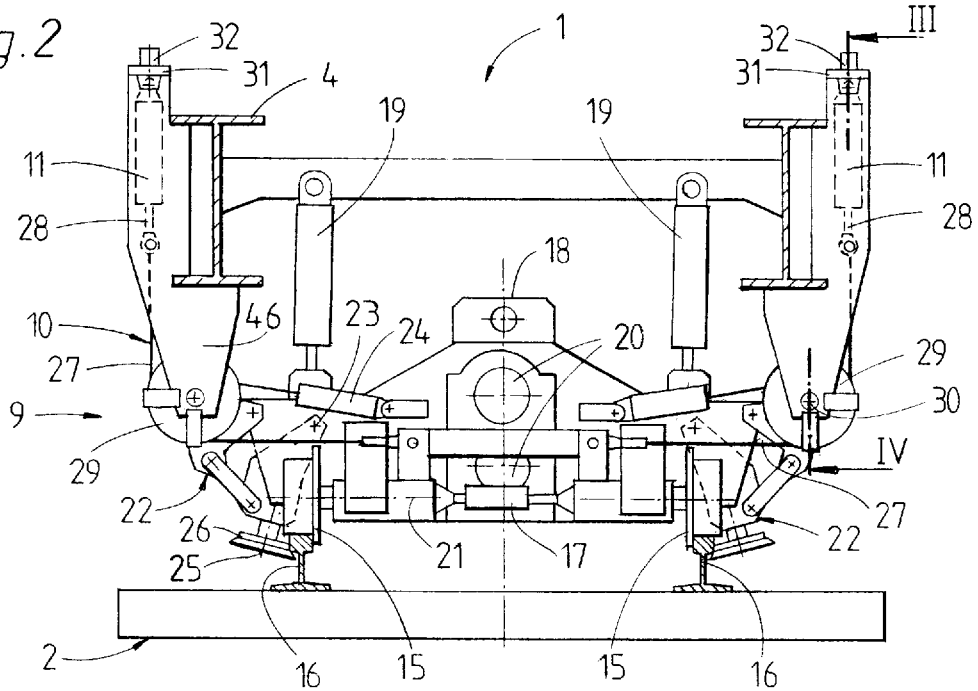
FIG. 2 is an enlarged transverse section along line II of FIG. 1, showing an end view of one embodiment of a track stabilization assembly.

As shown in FIG. 2, track stabilization assembly 9 is generally conventional and is of the type fully disclosed in the above-described patents. It has flanged rollers 15, 15 running on rails 16, 16 of track 2 to support the assembly on the track, and a hydraulically-operated spreading drive 17 is mounted between the pair of flanged rollers to press them against the track rails during operation to avoid any play between the flanged rollers and the track rails. The track stabilization assembly has a housing 18 which is vertically adjustably mounted on machine frame 4 by hydraulic drives 19, 19. Two vibrators 20, 20 are mounted in housing 18. The vibrators are arranged to generate oscillations extending parallel to axes of rotation 21 of flanged rollers 15. Roller clamp 22 is arranged centrally between pairs of flanged rollers 15 associated with each track rail 16, and each roller clamp is mounted on housing 18 for pivoting about axis 23 extending in the longitudinal direction of machine frame 4, i.e. track 2. Hydraulic drive 24 is linked to each pivotal roller clamp to enable the roller clamp to be pivoted into engagement with track rail 16 so that each track rail is held firmly between pairs of flanged rollers 15 and roller clamp 22. Each roller clamp end holds roller 26 freely rotatable about axis 25.

In the embodiment illustrated in FIG. 2, the lining drive means comprises a respective lining drive 11 at a respective side of machine frame 4. Each lining drive is a hydraulic drive comprising piston rod 28, and the spacing member comprises rope 27 connecting piston rod 28 to housing 18 of track stabilization assembly 9. Each lining drive 11 extends longitudinally in a substantially vertical direction, and further comprising guide roller 29 mounted on machine frame 4 for rotation about a substantially horizontal axis extending substantially parallel to track 2. Rope 27 is trained about guide roller 29 and the guide roller is arranged to deflect the rope about 90°. A section of rope 27 extends horizontally between guide roller 29 and track stabilization assembly 9 substantially perpendicularly to track 2.

Figure 4:
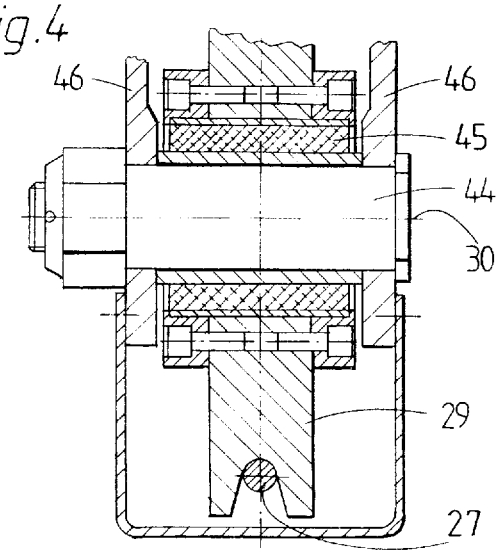

As shown in FIG. 4, a bolt axle 44 mounts guide roller 29 on flange 46 affixed to machine frame 4, the upper end of the flange being connected to bearing element 31 of the machine frame for lining drive 11. Cylindrical elastic damping element 45 is interposed between bolt axle 46 and guide roller 29.

Figure 3:
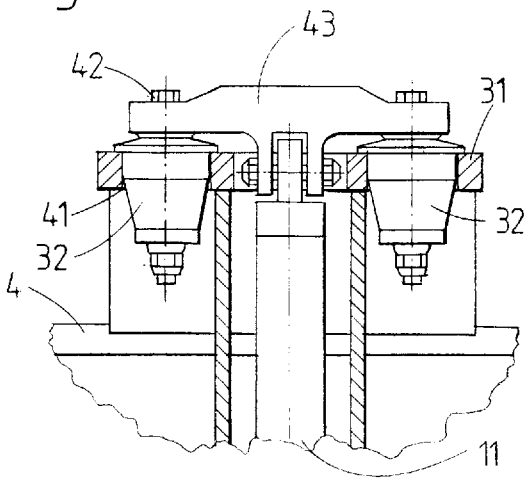
FIGS. 3 and 4 are further enlarged cross sections along lines III and IV, respectively, of FIG. 2.

As illustrated in FIG. 3, the machine frame bearing element is a flange 31 which serves to link an end of the cylinder of lining drive 11 to machine frame 4. Two elastic members 32, which are spaced from each other in the direction of the track, are held in bores 41 of bearing flange 31 and are interposed between the lining drive end and this bearing element. Lining drive 11 is pivotally suspended on yoke 43 extending in the longitudinal direction of the machine frame, and the yoke is held on elastic members 32 by vertically extending threaded bolts 42 which are tightened to exert pressure on the elastic members and press them into bores 41. The lining force is thus transmitted from bearing element 31 of machine frame 4 to track stabilization assembly 9 and track 2 through interposed elastic members 32 and yoke 43.

Figure 5:
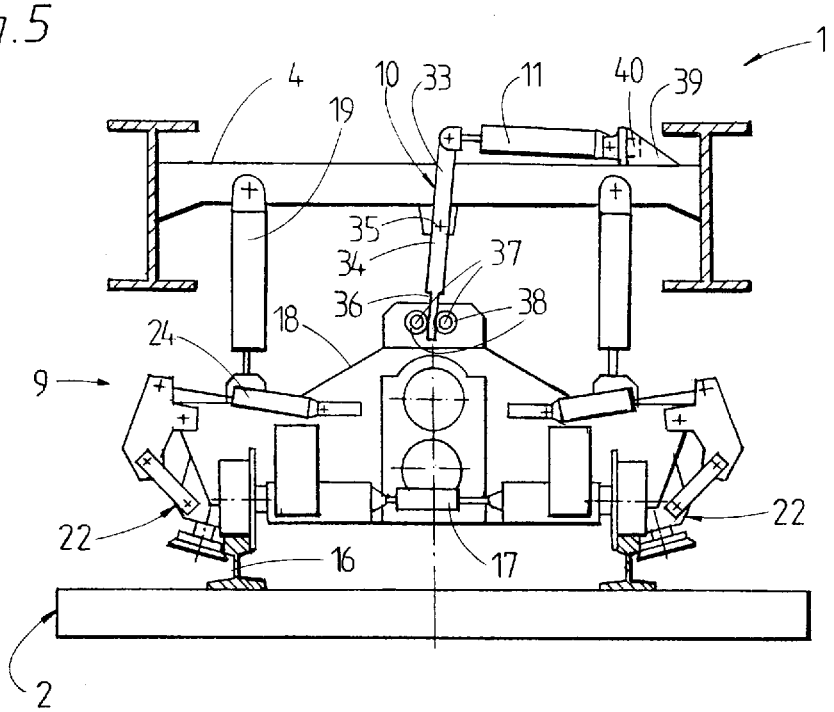
FIG. 5 is a view similar to that of FIG. 2, showing another embodiment of the track stabilization assembly.

In the embodiment illustrated in FIG. 5, like reference numerals have been used for like parts functioning in a like manner as in the embodiment of FIGS. 1 to 4. In this embodiment, the lining drive means comprises a lining drive 11 extending transversely to track 2, and spacing member means 10 is a lever 33 extending longitudinally in a substantially vertical direction. The lever has an upper end linked to the piston rod of lining drive 11, a lower end 36 linked to housing 18 of the track stabilization assembly, and a fulcrum 35 between the upper and lower ends, fulcrum 35 linking lever 33 pivotally to the machine frame for pivoting the lever about an axis extending in the longitudinal direction of the machine frame.

As shown, track stabilization assembly 9 carries a pair of entrainment bolts 37 spaced from each other transversely to the track, and lower lever end 36 is engaged between the entrainment bolts to enable the lower lever end to glide therebetween when lining drive 11 is actuated. Elastic element 38 is interposed between each entrainment bolt 37 and lower lever end 36. As in the first-described embodiment, elastic member 40 is interposed between lining drive 11 and bearing element 39 of machine frame 4.

To enable the position of lining reference base 13 of reference system 12 to be accurately detected despite the vibrations to which the machine is subjected, it is advantageous to use a so-called contactless linear absolute path sensor. The measuring principle of such a sensor is based on the measurement of the operating time (within the ultrasound range). The ultrasound operating time is proportional to the path and is processed in a computer.

Reference base 13 is a magnetostrictive tensioned wire through which a current pulse is transmitted to produce an annular magnetic field around the wire. The position sensor is a magnetic system, which does not contact the wire, whose magnetic field extends tangentially to the current-conducting wire. The second annular magnetic field generated by current pulses produces magnetostriction at the measuring point by the two differently oriented magnetic fields. The ultrasound signals produced thereby radiate from the position sensor in both directions. A measuring signal pick-up in the sensor receives the ultrasound signal and converts it into an electrical pulse. The ultrasound waves moving in the direction of the end of the rod are absorbed in a damping zone. The difference in time from the emission of the current pulse to the reception of the torsion pulse is converted by the computer into a path information generated at the output as a digital or analog signal.

What we claim is:

1. A machine for lining a track, which comprises (a) a machine frame supported on the track by undercarriages, (b) a track stabilization assembly vertically adjustably mounted on the machine frame and engaging the track, the track stabilization assembly comprising (1) vibrating means for generating oscillations of the track engaged by the assembly, (c) a reference system comprising a lining reference base, (d) lining drive means linking the track stabilization assembly to the machine frame for displacing the track engaged by the track stabilization assembly in a direction extending transversely to the track into a position controlled by the lining reference base, the lining drive means comprising at least one lining drive comprising a piston rod, (e) the machine frame comprising a bearing element for linking an end of the lining drive to the machine frame, (f) a spacing member means interposed between the lining drive means and the track stabilization assembly, the spacing member means comprising a rope connecting the piston rod to the track stabilization assembly, (g) the track stabilization assembly comprising a bearing element for linking an end of the spacing member means to the track stabilization assembly, and (h) an elastic member interposed between at least one of the bearing elements and said end.

2. The track lining machine of claim 1, wherein the lining drive extends longitudinally in a substantially vertical direction, and further comprising a guide roller mounted on the machine frame for rotation about a substantially horizontal axis extending substantially parallel to the track, the rope being trained about the guide roller and the guide roller being arranged to deflect the rope about 90°.

3. The track lining machine of claim 2, further comprising a bolt axle mounting the guide roller on the machine frame, and a cylindrical elastic damping element interposed between the bolt axle and the guide roller.

4. The track lining machine of claim 2, wherein a section of the rope extends horizontally between the guide roller and the track stabilization assembly substantially perpendicularly to the track.

5. The track lining machine of claim 1, wherein the lining drive means comprises a respective lining drive mounted at each side of the machine frame, each lining drive extending longitudinally in a substantially vertical direction, and further comprising a respective guide roller mounted on the machine frame for rotation about a substantially horizontal axis extending substantially parallel to the track, the rope being trained about the guide roller and the guide roller being arranged to deflect the rope about 90°.

* * * * *